US010519620B2

(12) United States Patent
Friedrich

(10) Patent No.: US 10,519,620 B2
(45) Date of Patent: Dec. 31, 2019

(54) QUICK HITCH FOR TOOLS OF EXCAVATORS, CRANES, CRAWLER-TYPE VEHICLES OR THE LIKE

(71) Applicant: Kinshofer GmbH, Waakirchen (DE)

(72) Inventor: Thomas Friedrich, Schilersee (DE)

(73) Assignee: KINSHOFER GMBH, Waakirchen (DE)

( * ) Notice: Subject to any disclaimer, the term of this patent is extended or adjusted under 35 U.S.C. 154(b) by 413 days.

(21) Appl. No.: 15/405,731

(22) Filed: Jan. 13, 2017

(65) Prior Publication Data

US 2017/0233978 A1 Aug. 17, 2017

(30) Foreign Application Priority Data

Feb. 12, 2016 (DE) ..... 20 2016 000 930 U

(51) Int. Cl.
*E02F 3/36* (2006.01)
*E02F 3/32* (2006.01)

(52) U.S. Cl.
CPC ..... *E02F 3/3609* (2013.01); *E02F 3/3663* (2013.01); *E02F 3/32* (2013.01)

(58) Field of Classification Search
CPC ..... E02F 3/3609; E02F 3/3645; E02F 3/3654; E02F 3/3677; E02F 3/3681; E02F 3/3686;
(Continued)

(56) References Cited

U.S. PATENT DOCUMENTS 3,033,394 A 5/1962 Kashergen
3,599,996 A * 8/1971 Holt ..... B23B 31/18 279/37

(Continued)

FOREIGN PATENT DOCUMENTS

DE 8125814 U1 12/1981
DE 3135150 C1 1/1983

(Continued)

OTHER PUBLICATIONS

Search Report for German Patent Application No. 20 2016 000 930.4, dated Nov. 28, 2016.

(Continued)

*Primary Examiner* — Michael P Ferguson
(74) *Attorney, Agent, or Firm* — Troutman Sanders LLP; Ryan Schneider

(57) ABSTRACT

A quick hitch for coupling and decoupling a tool at a rotator for rotating the tool that has a rotator attachment part that is attachable to an excavator arm or the like and that has a rotary rotator part rotatable relative thereto, wherein the quick hitch has a coupling part at the rotator side that is fastenable to the rotatable rotary rotator part and has a coupling part at the tool side, wherein the two coupling parts can be brought into engagement with one another and can be latched to one another by at least one latch element. A latch operating actuator is provided at the rotator attachment part for actuating a latch adjustment part movably arranged at one of the coupling parts for the unlatching and/or latching of the latch element, the latch operating actuator being rotatable about the rotator axis of rotation relative to the latch adjustment part.

15 Claims, 5 Drawing Sheets

(58) Field of Classification Search
CPC ..... E02F 9/2271; E02F 9/2275; E02F 9/2866; E02F 3/3663; B66C 3/005; F16B 7/0413; F16B 7/042; F16B 21/06; F16B 21/08; F16B 21/086; F16B 21/09; F16L 37/086; Y10T 403/599; Y10T 403/602; Y10T 403/604; Y10T 403/608; Y10T 403/591; Y10S 464/901; F16D 1/10; F16D 1/108; F16D 1/112; F16D 3/185
USPC ..... 464/158, 182, 901; 403/325, 327, 328, 403/330, DIG. 4
See application file for complete search history.

(56) References Cited

U.S. PATENT DOCUMENTS 3,701,549 A * 10/1972 Koomey ..... E21B 33/038 285/24
4,453,745 A * 6/1984 Nelson ..... E21B 33/038 285/18
4,636,135 A * 1/1987 Bancon ..... B25J 15/0491 29/26 A
4,664,588 A * 5/1987 Newell ..... B23Q 1/0063 294/86.4
4,708,376 A * 11/1987 Jennings ..... E21B 33/038 285/18
4,850,734 A * 7/1989 Naumec ..... B23B 31/261 403/322.1
4,854,777 A * 8/1989 Lennoine ..... B63B 21/502 405/202
4,897,014 A * 1/1990 Tietze ..... B25J 15/0206 279/2.23
5,255,743 A * 10/1993 Adam ..... E21B 33/038 166/345
6,163,988 A 12/2000 Pratt et al.
8,474,537 B2 * 7/2013 Voss ..... E21B 33/038 166/338

FOREIGN PATENT DOCUMENTS

DE 4010070 C1 11/1991
DE 202011100482 U1 8/2012
DE 102011081578 A1 2/2013

OTHER PUBLICATIONS

Extended European Search Report issued by the European Patent Office for related European Patent Application No. 16194704.9 dated May 8, 2017.

* cited by examiner

QUICK HITCH FOR TOOLS OF EXCAVATORS, CRANES, CRAWLER-TYPE VEHICLES OR THE LIKE

CROSS-REFERENCE TO RELATED APPLICATIONS

This application claims the benefit of German Utility Model Application No. 20 2016 000 930.4 filed 12 Feb. 2016, the entire contents and substance of which is hereby incorporated by reference.

BACKGROUND OF THE INVENTION

1. Field of Invention

The present invention relates to a quick hitch for coupling and decoupling a tool at a rotator for rotating the tool that has a rotator attachment part that is attachable to an excavator arm and/or to a crane boom and/or to crawler forklifts or the like and that has a rotary rotator part rotatable relative thereto, wherein the quick hitch has a coupling part at the rotator side that is fastenable to the rotatable rotary rotator part and has a coupling part at the tool side, wherein the two coupling parts can be brought into engagement with one another and can be latched to one another by at least one latch element.

2. Background and Related Art

Quick hitches are used with hydraulic excavators, crawler-type vehicles and similar construction machinery and earth-working machinery as well as with mobile cranes or loader cranes as well as with similar material handling units to be able to couple different tools to the boom, arm or tool guiding carrier of the respective machine and to be able to replace them with one another quickly, wherein they can, for example, be digging tools, clearing tools, gripping and/or lifting tools such as digging buckets, clam shell buckets, rock grapples, timber or pipe grapples and similar tools. In this respect, one coupling half, part or portion is typically fastened to the tool and a second coupling half, part or portion is fastened to the excavator or crane or to the corresponding machine such that only the two coupling halves have to be moved together and latched. The two coupling halves are in this respect typically moved into one another or toward one another along a coupling axis or a coupling trajectory and can be latched to one another by one or more latch elements that can be moved in and out transversely to the named coupling axis or coupling trajectory. In this respect, hydraulic or pneumatic latch operating actuators can typically be provided for moving the latch elements in and out and can be configured, for example, in the form of hydraulic cylinders. It is also known in this respect to preload the latch elements into a position, for example into the latching position, by spring elements and to use the latch operating actuator only for one direction of movement of the latch elements, for example for unlatching. Independently of this, the latch operating actuators can be supplied by energy lines such as hydraulic hoses, with the energy supply lines having to follow the movements of the coupling half at the machine side and having to be configured as correspondingly multi-axially movable since, for example, a crane grapple of a mobile crane is multi-axially movable with respect to the boom.

If the quick hitch is used in conjunction with a rotator, it is typically not sufficient to lead the energy supply lines around the tilt and pivot axes with a corresponding bulge since such rotators typically do not have any limiting angle of rotation, but can rather—at least theoretically—carry out as many revolutions in the same direction as required. Such a rotator or rotational drive typically has a rotator attachment part that so-to-say forms the fixed stator part and is attached to the excavator arm or crane boom or the like, with the rotator attachment part naturally not really being stationary, but rather also being multiaxially movable by the excavator arm or crane boom and also relative thereto in space, for example being tiltable about two horizontal spatial axes and being travelable as desired in space by the excavator arm or crane boom. The rotary rotator part can be rotated about a rotator axis of rotation relative to the rotator attachment part, with the rotator axis of rotation frequently being oriented upright, in particular when the tool is guided in a suspended manner below the boom arm, to be able to rotate the tool about an upright spatial axis.

Since the coupling half of the quick-coupler at the machine side is naturally fastened to the rotating rotary rotator part so that the tool can carry out the rotational movements of the rotator, the latch elements by means of which the two quick hitch coupling halves are latched to one another also correspondingly co-rotate. An actuation of the latch elements is not very simple in this regard. Even if, for example, a latch adjustment movement can still be carried out relatively simply by preloading the latch elements, special measures have to be provided for the opposite movement by the latch operating actuator or a manual unlatching has to be carried out that requires the machine operator to climb down from the operator cabin. To avoid this, it has already been proposed to provide a rotary union through the rotator for the energy supply of the latch operating actuator, via which rotary union, for example, hydraulic pressure can be applied to the latch operating actuator arranged at the coupling half at the rotator side. Such a rotary union comprises, in the case of a hydraulic supply circuit, an annular passage or a central pressure passage that is to be sealed using corresponding sealing measures at the interface between the rotary attachment and the rotary rotator part. In the case of an electrical energy supply of the latch operating actuator, such a rotary union can comprise annular sliding contacts with which the interface between the rotator attachment part and the rotary rotator part is bridged. In both cases, such a rotary union through the rotator is complex and/or expensive. In addition, the degree of construction freedom for the configuration of the rotational bearing of the two rotator parts is hereby restricted.

Starting from this, it is the underlying object of the present invention to provide an improved quick hitch of the initially named type which avoids disadvantages of the prior art and further develops the latter in an advantageous manner. A simple, but still reliable latching and unlatching of the two coupling halves should in particular also be made possible by a rotator without requiring complex and/or expensive rotary unions being required through the rotator for the energy supply of the latch operating actuator.

BRIEF SUMMARY OF THE INVENTION

Briefly described, in a preferred form, the present invention comprises a quick hitch for coupling and decoupling a tool at a rotator for rotating the tool, the rotator having a rotator attachment part that is attachable to an excavator arm and/or to a crane boom and/or to crawler forklifts or another tool carrier, and a rotary rotator part rotatable relative to the rotator attachment part, wherein the quick hitch comprises a rotator coupling half/part/portion that is fastenable to the rotatable rotary rotator part, and tool coupling half/part/ portion, wherein the two coupling halves/parts/portions are configured to be brought into engagement with one another and can be latched to one another by at least one latch element, wherein a latch operating actuator is provided at the rotator attachment part for actuating a latch adjustment part that is movably arranged at one of the two coupling halves/parts/portions for the unlatching and/or latching of the latch element, the latch operating actuator being rotatable about the rotator axis of rotation relative to the latch adjustment part.

In another embodiment, the present invention is a machine assembly comprising the present quick hitch and a rotator that has a rotator attachment part for attachment to an excavator arm and/or crane boom and/or crawler forklifts or another tool carrier, and has a rotary rotator part rotatable with respect to the rotator attachment part.

It is therefore proposed no longer to provide the latch operating actuator at one of the two co-rotating coupling halves, but rather to arrange it at the stationary rotator attachment part and to provide a latch adjustment part to transfer the adjustment movement of the latch operating actuator to the latch element, the latch adjustment part being rotatable with respect to the latch operating actuator and being able to co-rotate with the coupling halves fastened to the rotary rotator part. Due to the arrangement of the latch operating actuator at the non-rotating rotator attachment part, the energy supply of the latch operating actuator does not require any rotary union through the rotator. In accordance with the invention, a latch operating actuator is provided at the rotator attachment part for actuating a latch adjustment part that is movably arranged at one of the two coupling parts for the unlatching and/or latching of the latch element, the latch operating actuator being rotatable about the rotator axis of rotation relative to the latch adjustment part. The degree of rotational freedom is therefore no longer required in the region of the energy supply of the latch operating actuator, but is rather provided in the mechanical adjustment train or power train line between the latch operating actuator and the latch element.

The latch adjustment part that can co-rotate with the rotary rotator part can have different configurations with respect to its contour and arrangement. For example, the latch adjustment part can be a slide button or an adjustment lever that is movably supported at a coupling half and is connected to the latch element and has an adjustment surface with which the latch operating actuator arranged at the rotator attachment part can be brought into engagement to cause or to carry out the sliding and/or tilting movement of the slide button or adjustment lever respectively. Depending on the configuration of the latch element itself, the named latch adjustment part can be directly formed by a section or part of the latch element or can be fixedly connected thereto or connected thereto in an articulated manner. If, for example, the at least one latch element is provided at the coupling part at the rotator side, the latch adjustment part can form an adjustment lever part movably supported at the coupling part at the rotator side.

Alternatively or additionally, however, a latch adjustment part can also be provided that is formed separately of the latch element and that can be releasably brought into engagement with the latch element to produce an unlatching movement or a latching movement of the latch element by a corresponding adjustment movement of the latch adjustment part. The at least one latch element can, for example, be provided at the coupling half at the rotator side and can be supported there movable inwardly and outwardly, whereas the latch adjustment part can be arranged and movably supported at the coupling half at the tool side. If the two coupling halves are moved into one another or toward one another in accordance with their intended purpose the latch adjustment part at the coupling half at the tool side comes to lie at or in the vicinity of the latch element that is provided at the coupling half at the rotator side such that, on an adjustment movement of the latch adjustment part, the latch element can be brought into engagement with the latch adjustment part and can be actuated by the latch adjustment part.

Such a separate and mutually releasable configuration of the latch element and of the latch adjustment element is also possible with a reverse arrangement of the latch element at the coupling part at the tool side and of the latch adjustment part at the coupling part at the rotator side or also with a common arrangement of the latch element and of the latch adjustment part at the same coupling half.

The adjustment surface of the latch adjustment part that can be acted on at the rotator attachment part by the latch operating actuator can generally have different designs; it can, for example, form a limited, plate-shaped adjustment surface, with the rotator in this case being able to be brought into a specific rotational position in which the latch adjustment part comes to lie at the latch operating actuator and can be actuated by the latter. To allow an actuation of the latch adjustment part in different rotational positions of the rotator, the latch adjustment part can, however, advantageously also have an adjustment ring that extends in annular form about the rotator axis of rotation and against which the latch adjustment actuator is movable so that the latch adjustment part is movable by the latch adjustment actuator. Such an adjustment ring about the rotator axis of rotation provides the latch operating actuator at the non-rotating rotator attachment part with an engagement surface in different rotational positions of the rotary rotator part since the adjustment ring so-to-say rotates beneath the actuator, but always forms an engagement surface for it.

The adjustment ring can be a completely closed ring that allows an actuation of the latch adjustment part fully independently of the rotational position of the rotator. Alternatively to such a full ring, the adjustment ring can, however, also be configured as a part ring or as a ring segment in order to allow a latch operation at least in different rotational positions—for example a tool position in parallel with the boom and a tool position aligned transversely to the boom. A continuous full ring is, however, preferred that allows a latch operation in all rotational positions.

Kinematically reversed, the adjustment ring can also be associated with the latch operating actuator and can extend non-rotatably about the rotator attachment part so that the co-rotating latch adjustment part associated with the rotary rotator part can rotate beneath and beyond the adjustment ring that does not then co-rotate. The adjustment ring then carries out the adjustment movement of the latch operating actuator and can be brought into engagement with the latch adjustment part since the adjustment ring can be brought into engagement with the latch adjustment part independently of the rotational position of the rotator. In this case, the adjustment ring so-to-say forms a runway along which the latch adjustment part can be rotated or beyond which the latch adjustment part moves when the latch adjustment part is rotated with the rotary rotator part.

Alternatively or additionally to the described embodiments, two adjustment rings can also be provided of which one can be arranged in a rotationally stationary manner at the rotator attachment part and can be movably supported in accordance with the adjustment movement of the latch operating actuator and can, for example, extend about the rotator attachment part, whereas the other one of the two adjustment rings can be arranged in a manner co-rotating with the rotary rotator part at one of the two coupling halves and can be movably supported such that an adjustment movement of the adjustment ring unlatches and/or latches the latch element. The adjustment movement of the co-rotating adjustment ring can in this respect be produced by an adjustment movement of the adjustment ring that does not co-rotate by an actuation of the adjustment operating actuator. The two adjustment rings can in this respect have at least approximately the same radius to be able to be pressed toward one another.

Independently of the specific configuration and arrangement of one or more adjustment rings, the quick hitch is advantageously configured such that the latch operating actuator, on the one hand, and the latch adjustment part, on the other hand, have at least approximately the same spacing from the rotator axis of rotation or are arranged on part circles that have the same radius about the rotator axis of rotation at least in the state of the two coupling halves moved toward one another. The latch operating actuator can hereby be brought into engagement with the latch adjustment part, even if the rotator attachment part and the rotary rotator part are rotated with respect to one another.

In an advantageous further development of the invention, the adjustment ring can extend in a plane that extends at least approximately perpendicular to the rotator axis of rotation. The adjustment ring could optionally also have a slightly oblique slant, for example a gradient with respect to the rotator axis of rotation or a gradient in a radial direction. An extent of the adjustment ring in the plane perpendicular to the rotator axis of rotation is, however, preferred.

The latch operating actuator and/or the latch adjustment part cooperating therewith can each have an adjustment movement axis that can extend substantially in parallel with the rotator axis of rotation. The adjustment movement axis of the latch operating actuator and/or the latch adjustment part could optionally also extend obliquely to the rotator axis of rotation and/or could have a curvature, for example when an adjustment lever is provided that produces the desired adjustment movement.

On an alignment of the adjustment ring in a plane perpendicular to the rotator axis of rotation and of an adjustment movement axis of the operating actuator and of the adjustment part in parallel with the rotator axis of rotation, a highly efficient implementation of the adjustment movement can be achieved without losses.

Independently of the specific embodiment of the adjustment actuator and/or of the latch adjustment part, the coupling halves can be configured such that the two coupling halves can be moved into one another and/or apart from one another along a coupling trajectory or axis and the coupling trajectory can extend substantially in parallel with the rotator axis of rotation. The coupling half at the rotator side can hereby be moved in the direction of the rotator axis of rotation in a more or less straight manner into or toward the coupling half at the tool side, whereby the coupling procedure can be carried out in a facilitated manner. The coupling halves are advantageously configured in this respect such that no additional rotation between the two coupling halves is necessary in addition to the linear or trajectory coupling movement; the additional rotation could, however, nevertheless be provided when a bayonet-like moving into one another is desired. For the sake of a simple actuation, the coupling halves can, however, have mutually complementary coupling contours or coupling contours fitting toward and/or into one another that can be brought into engagement with one another and are releasable from one another by a single-axis coupling movement.

The at least one latch element can advantageously have a latch movement axis or a latch trajectory that has at least one movement component transverse to the rotator axis of rotation. The at least one latch element can in particular be traveled inwardly and outwardly approximately radially to the rotator axis of rotation or can have a radial movement component on the unlatching and latching.

In a further development of the invention, a plurality of latch elements arranged in a star shape with respect to one another can be provided whose unlatching movement and latching movement can each have a radial component.

In an advantageous further development of the invention, the latch adjustment part by means of which the at least one latch element can be unlatched and/or latched can have an oblique surface that can produce a radial adjustment movement of the latch element or a movement of the latch element transversely to the rotator axis of rotation with a linear adjustment movement of the latch adjustment part in parallel with the rotator axis of rotation and/or in parallel with the coupling axis of the two coupling halves. The oblique surface in this respect slides along the latch element, with the slant converting the linear movement in the direction of the rotator axis of rotation into a latch adjustment movement transversely thereto.

The quick hitch or its coupling half at the rotator side, including the latch operating actuator, can be an integral component of the rotator; for example, the coupling half at the rotator side can be fixedly molded to the rotator axis of rotation and/or can be an integral component thereof and the latch operating actuator can be fixedly fastened to the rotator attachment part. Alternatively to such an integral configuration, the quick hitch can, however, also form a separate assembly whose components at the rotator side can be subsequently and/or releasably mounted to the rotator. A simple retrofitting of rotators already in operation with a quick hitch can hereby in particular already take place. This is in particular made possible in that the present quick hitch does not require any energy passage or rotary union through the rotator itself.

These and other objects, features and advantages of the present invention will become more apparent upon reading the following specification in conjunction with the accompanying drawing figures.

BRIEF DESCRIPTION OF THE DRAWINGS

Various features and advantages of the present invention may be more readily understood with reference to the following detailed description taken in conjunction with the accompanying drawings, wherein like reference numerals designate like structural elements, and in which.

DETAILED DESCRIPTION OF THE INVENTION

Figure 1:
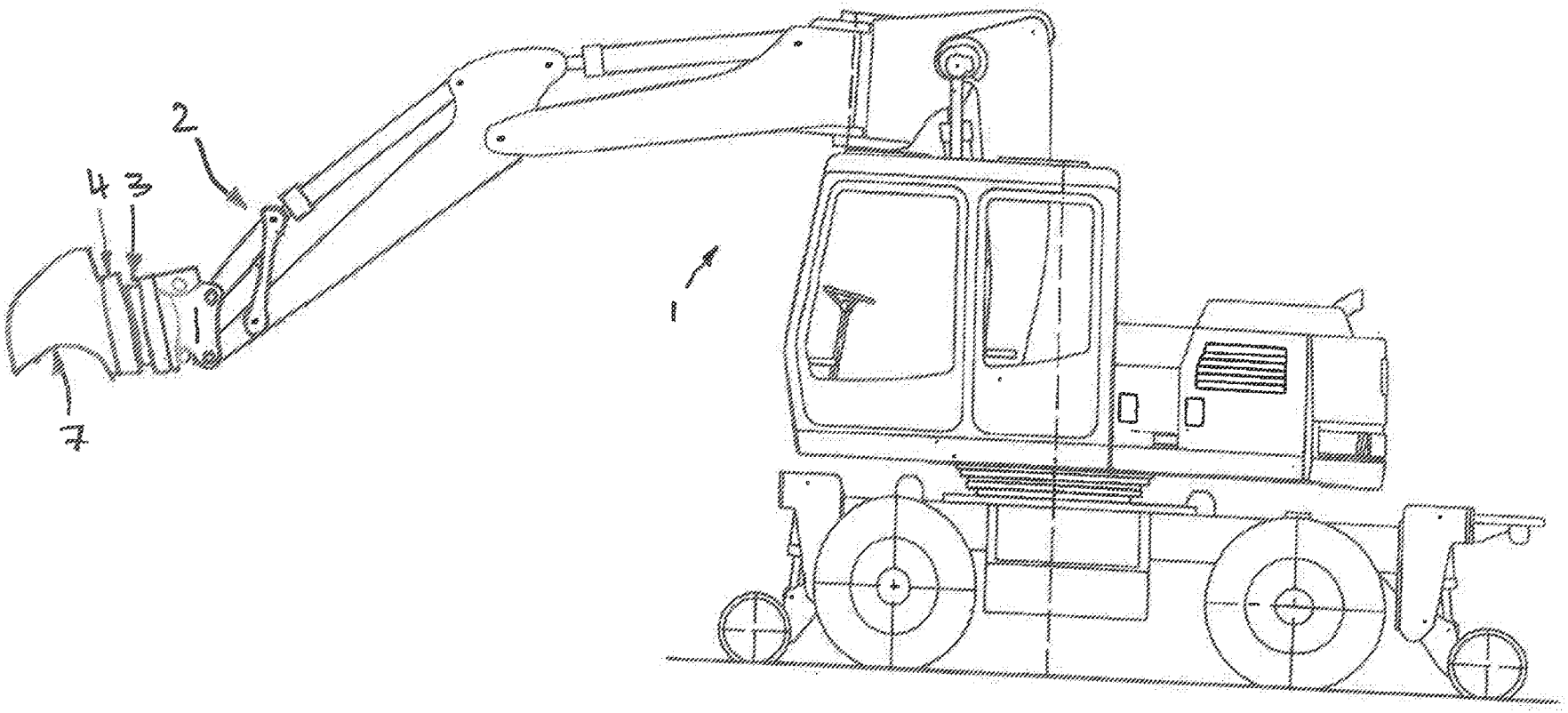
FIG. 1 is a schematic side view of an excavator having a quick hitch between the excavator arm and the digging tool in accordance with an advantageous embodiment of the invention.

To facilitate an understanding of the principles and features of the various embodiments of the invention, various illustrative embodiments are explained below. Although exemplary embodiments of the invention are explained in detail, it is to be understood that other embodiments are contemplated. Accordingly, it is not intended that the invention is limited in its scope to the details of construction and arrangement of components set forth in the following description or illustrated in the drawings. The invention is capable of other embodiments and of being practiced or carried out in various ways. Also, in describing the exemplary embodiments, specific terminology will be resorted to for the sake of clarity.

It must also be noted that, as used in the specification and the appended claims, the singular forms "a," "an" and "the" include plural references unless the context clearly dictates otherwise. For example, reference to a component is intended also to include composition of a plurality of components. References to a composition containing "a" constituent is intended to include other constituents in addition to the one named.

Also, in describing the exemplary embodiments, terminology will be resorted to for the sake of clarity. It is intended that each term contemplates its broadest meaning as understood by those skilled in the art and includes all technical equivalents which operate in a similar manner to accomplish a similar purpose.

Ranges may be expressed herein as from "about" or "approximately" or "substantially" one particular value and/or to "about" or "approximately" or "substantially" another particular value. When such a range is expressed, other exemplary embodiments include from the one particular value and/or to the other particular value.

Similarly, as used herein, "substantially free" of something, or "substantially pure", and like characterizations, can include both being "at least substantially free" of something, or "at least substantially pure", and being "completely free" of something, or "completely pure".

By "comprising" or "containing" or "including" is meant that at least the named compound, element, particle, or method step is present in the composition or article or method, but does not exclude the presence of other compounds, materials, particles, method steps, even if the other such compounds, material, particles, method steps have the same function as what is named.

It is also to be understood that the mention of one or more method steps does not preclude the presence of additional method steps or intervening method steps between those steps expressly identified. Similarly, it is also to be understood that the mention of one or more components in a composition does not preclude the presence of additional components than those expressly identified.

The materials described as making up the various elements of the invention are intended to be illustrative and not restrictive. Many suitable materials that would perform the same or a similar function as the materials described herein are intended to be embraced within the scope of the invention. Such other materials not described herein can include, but are not limited to, for example, materials that are developed after the time of the development of the invention.

FIG. 1 shows by way of example an excavator 1 to whose boom 2 a digging tool 7 is connected in an articulated manner, with the digging tool 7 being attached by means of a quick hitch 4 to a rotator 3 by which the digging tool 7 can be rotated about an upright rotator axis of rotation. The rotator 3 itself can likewise be tiltable and/or pivotable at the boom arm of a tool carrier, for example, the boom 2, with the boom 2 being able to have pivoting and/or tilting kinematics known per se for this purpose and/or with such a pivotability and/or tiltability being able to be integrated in the rotator 3.

It is understood that the quick hitch 4 can also be provided at similar earth-moving equipment or material transfer equipment such as a telescopic mobile crane such as is used on trucks, for example.

FIGS. 2 to 5 show the quick hitch 4 and the rotator 3 at which the quick hitch 4 is mounted in more detail. The rotator 3 in this respect comprises in a manner known per se a rotator articulation part 8 that is installed at the machine side, in particular at the boom 3 of the excavator 1 or of another piece of equipment. A rotational rotator part 9 is rotatably supported at the rotator attachment part 8, with the rotator attachment part 8 forming an upper rotator part and the rotary rotator part 9 forming a lower rotator part and the rotator axis of rotation 10 being able to be an upright axis.

The quick hitch 4 comprises two coupling portions 5 and 6 of which a coupling portion 5 at the rotator side can be rotationally fixedly connected to the rotary rotator part 9 and can therefore be rotated with it about the rotator axis of rotation 10. A coupling portion 6 at the tool side can be rigidly connected to the tool 7 and forms a counter-piece to the coupling portion 5 at the rotator side so that the two coupling portions 5 and 6 can be moved toward one another, in particular into one another, and can be latched with one another.

Figure 2:
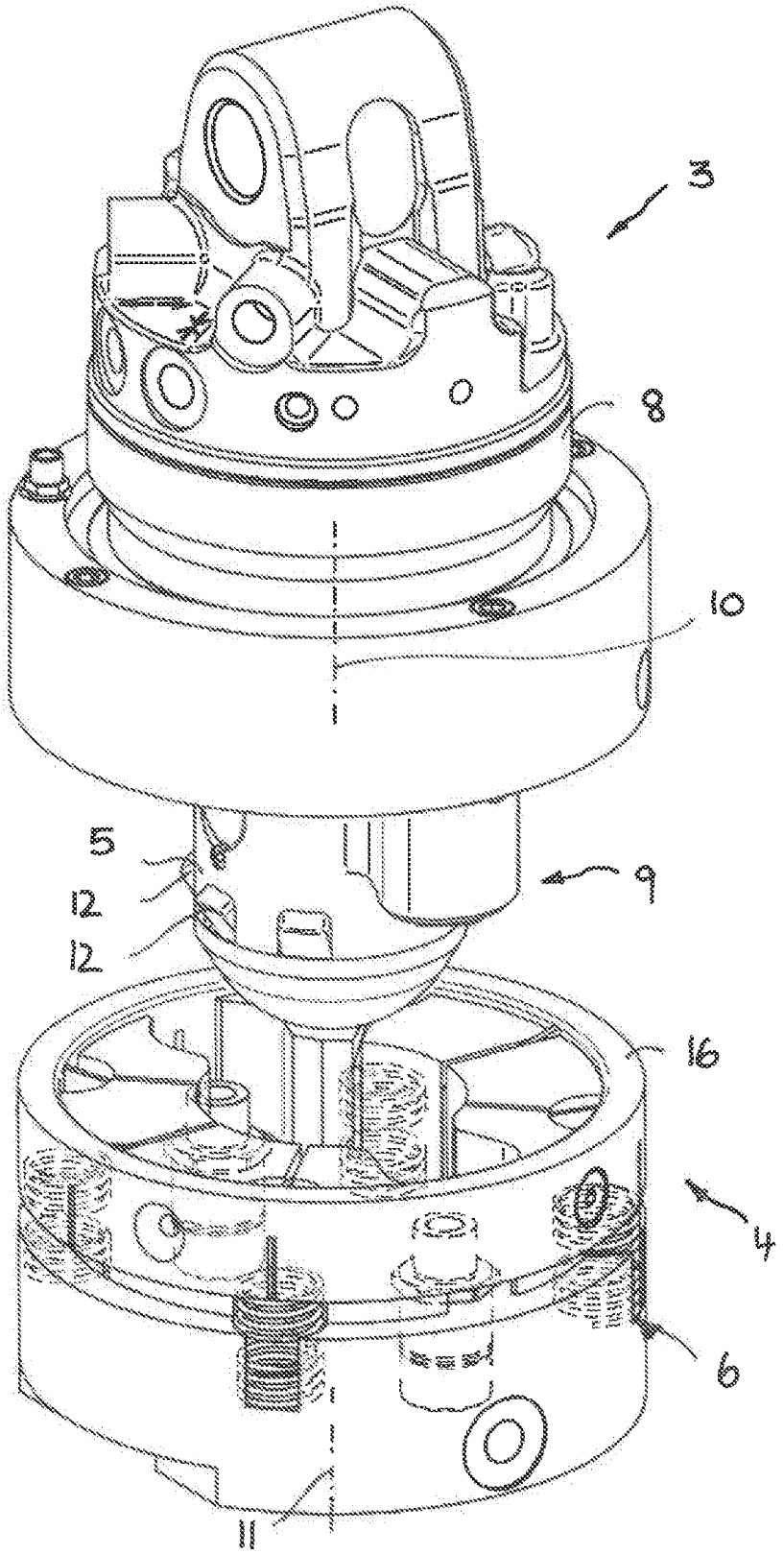
FIG. 2 is a schematic, perspective representation of the quick hitch of FIG. 1, with the two coupling portions being shown in the decoupled state moved apart from one another and with the arrangement of the one coupling portion at the rotator axis of rotation of a rotator being illustrated.

For example, one of the coupling portions can form a projecting coupling stub and the other coupling portion 6 can form a tub-like coupling mount into which the aforesaid coupling stub can be moved. As FIG. 2 shows, the coupling portion 5 at the rotator side can form the coupling stub and the coupling portion 6 at the tool side can form the tub-like coupling mount. It is, however, understood that other contours of the coupling portions can also generally be provided, for example plate-like contours.

Figure 3:
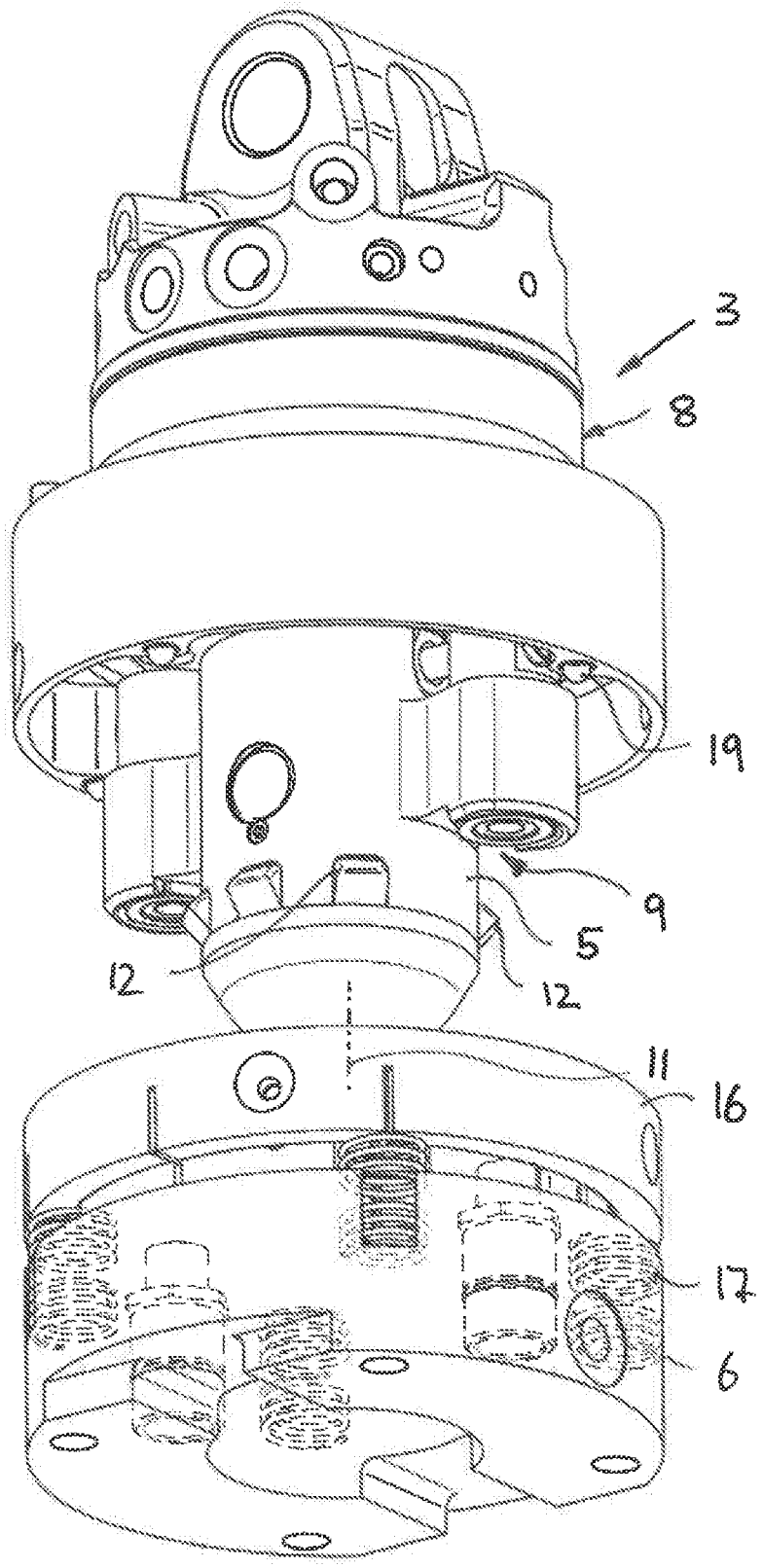
FIG. 3 is a schematic, perspective representation of the quick hitch similar to FIG. 2, with the two coupling portions decoupled from one another being shown obliquely from below from a different direction of view that shows the latch operating actuators at the rotator attachment part that does not co-rotate more clearly.
Figure 4:
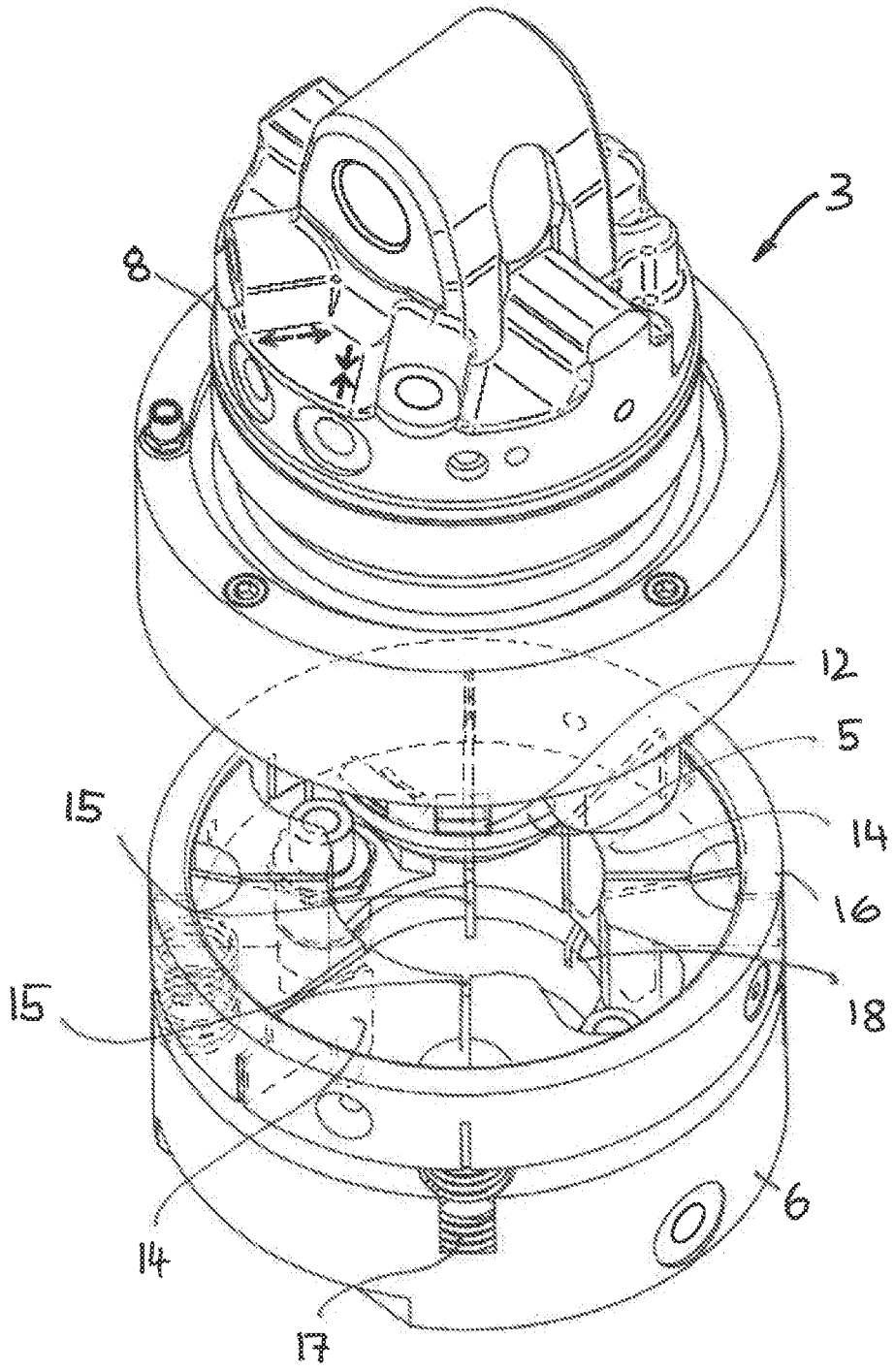
FIG. 4 is a schematic, perspective representation of the quick hitch similar to FIGS. 2 and 3 in a direction of view into the coupling part at the tool side that shows the displaceable latch adjustment parts and their slit-shaped guidance in the coupling part at the tool side.

As FIGS. 2-4 illustrate, the two coupling portions 5 and 6 are configured such that the two coupling portions 5 and 6 can be moved into one another or toward one another and can be released from one another by a linear coupling movement along a coupling axis 11, with the coupling axis 11 being able to extend substantially in parallel with the rotator axis of rotation 10. The two coupling portions 5 and 6 can in this respect be contoured, for example by a contour differing from the circular, the cylindrical or the conical shape, such that the two coupling portions 5 and 6 cannot be rotated against one another independently of their latching to one another in order to transmit the rotator rotations reliably to the tool 7, with the contour of the coupling portions 5 and 6 being able to be such that the two coupling portions 5 and 6 can only be moved in one alignment or also in different alignments, for example offset from one another by 90° or by 180°. Alternatively or additionally, the coupling portions 5 and 6 can, however, also be made rotationally fixed in a rotational manner with respect to one another by the latching to one another or can be blocked in a rotational manner with respect to one another such that the coupling portions 5, 6 can optionally also be configured such that they can move into one another in any desired rotational position.

As FIGS. 3 and 4 show, for example, lateral projections can, for example, be provided at the coupling stub that can move into corresponding cut-outs in the coupling tub to prevent a rotation.

To be able to latch the two coupling portions 5 and 6 to one another in the state moved toward one another, a plurality of latch elements 12 can be provided that can be provided at one or both coupling portions 5 and 6 and that can in this respect be movably supported such that the latch elements 12 can be moved inwardly and outwardly transversely to the coupling axis 11. The latch elements 12 can in this respect be linearly displaceably supported or can also be pivotably supported in the manner of latch levers.

Figure 5:
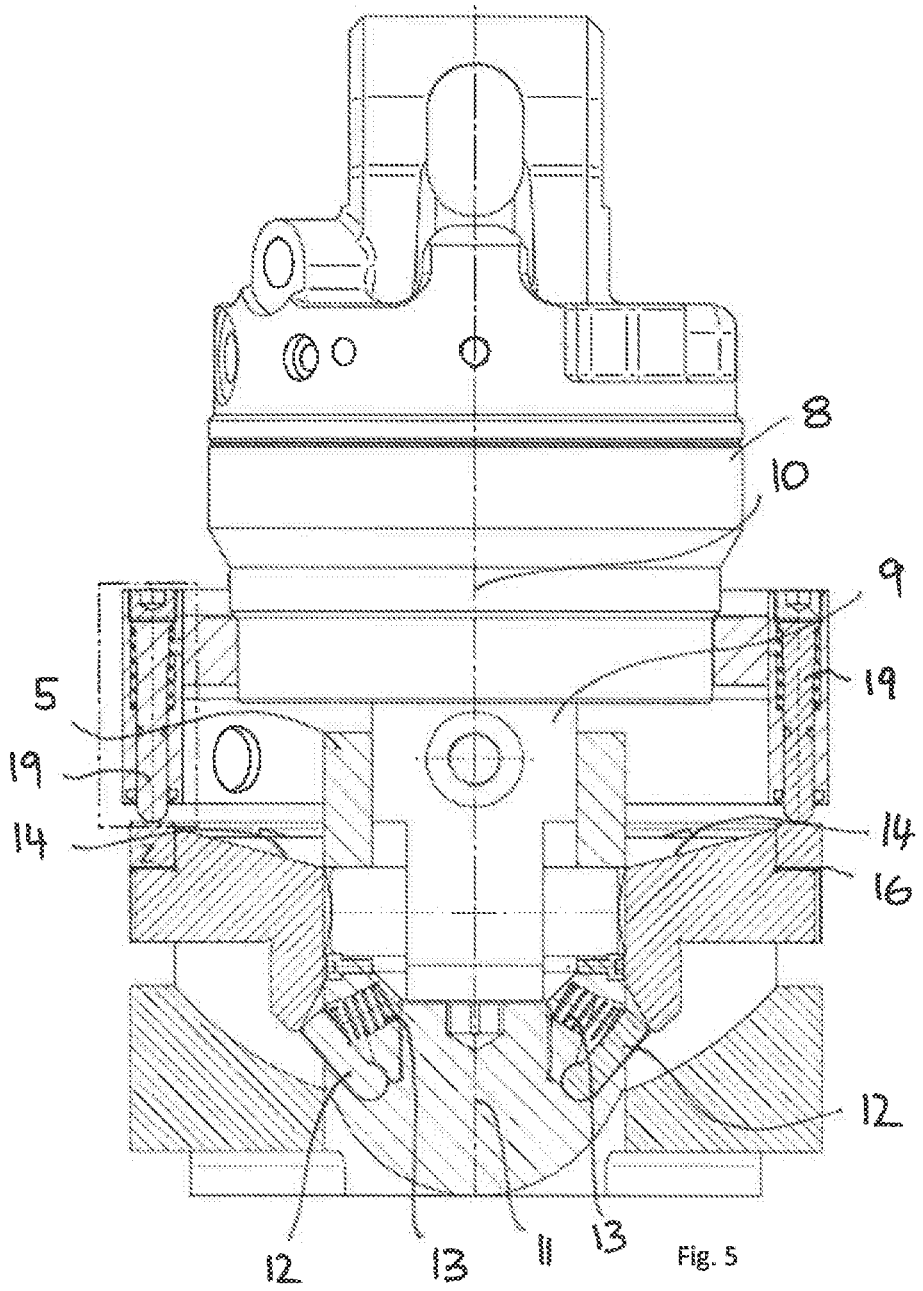
FIG. 5 is a schematic sectional view of the quick hitch of the preceding figures, with the latched state of the two coupling portions being shown and the latch adjustment parts and their oblique surfaces being shown still out of engagement with the latch elements.

As FIGS. 2 and 3 show, latch elements 12 can, for example, only be provided at the coupling portion 5 at the rotator side and can project in the latching position transversely to the stub-shaped coupling body of the coupling portion 5. These latch elements 12 can travel inwardly or can be pressed away on the movement into the bowl-shaped or tub-shaped cut-out of the coupling portion 6 at the tool side. If the two coupling portions 5 and 6 reach their coupling position in accordance with their intended purpose, the latch elements 12 can move out transversely and can engage behind the coupling portion 6 at the tool side or latch contours provided there, as FIG. 5 illustrates. The bowl-shaped coupling cut-out can, for example, have peripheral cut-outs or recesses in the coupling portion 6 into which the latch elements 12 can move.

The latch elements 12 can advantageously be preloaded into their latching position; for example by means of latch springs 13, cf. FIG. 5, and/or by means of another preloading apparatus, for example in the form of a pressure store.

The latch elements 12 can in this respect be contoured and/or arranged such that they move independently into their unlatched position, for example by a corresponding slanted surface contour, on the moving toward one another of the two coupling portions 5 and 6 despite their preloading into the latching position.

To be able to unlatch the latched latch elements 12, latch adjustment parts 14 can be provided at the coupling portion 6 at the tool side and can be movably supported, in particular displaceably supported, at the coupling part 6 at the tool side. The latch adjustment parts 14 can, for example, be longitudinally displaceably guided in parallel with the coupling axis 11, for example by means of guide slits 15 or other sliding guide means that can be provided at the coupling portion 6 at the tool side. As FIG. 4 shows, the latch adjustment parts 14 can form plate-like sliders that can be arranged in star shape and/or can be aligned in parallel with the coupling axis 11 and can be displaceably guided.

The latch adjustment parts 14 can be connected to a common adjustment ring 16 to be able to move all the latch adjustment parts 14 simultaneously and/or synchronously with one another.

Alternatively or additionally to such an adjustment ring 16, the latch adjustment parts 14 can be preloaded into an inactive position in which the latch adjustment parts 14 do not prevent the latch elements 12 from latching. This inactive position is shown in FIG. 5, with a spring device 17 or also another preloading device, for example in the form of a pressure store, being able to be provided for preloading the latch adjustment parts 14 into the inactive position. As FIG. 5 shows, spring elements can preload the latch adjustment parts 14 upwardly or toward the coupling part 5 at the rotator side.

As FIG. 5 shows, the latch adjustment parts 14 can have a slanted surface 18 that comes to lie at or in the vicinity of the latch elements 12 in the coupled position of the two coupling portions 5 and 6. If the latch adjustment parts 14 in accordance with FIG. 5 are brought downwardly or moved into their unlatching position, the slanted surfaces 18 slide along the latch elements 12, with the slanted surfaces 18 converting the adjustment movement of the latch adjustment parts 14 into an adjustment movement of the latch elements 12. While the latch adjustment parts 14 can be moved in parallel with the coupling axis 11, the slanted surfaces 18 can press the latch elements 12 inwardly transversely thereto or can force them into their unlatched position.

To be able to actuate the latch adjustment parts 14 against their preload into the inactive position, latch operating actuators 19 are provided at the rotator attachment part 8 that can, for example, be configured in the form of hydraulic cylinders. Other embodiments are, however, also possible such as in the form of an adjustment spindle and other drive principles are possible such as electrical drives.

The latch operating actuators 19 advantageously have an adjustment movement axis approximately in parallel with the rotator axis of rotation 10. If the latch operating actuators 19 are configured as pressure medium cylinders, single-action adjustment cylinders can be used, for example, in which the adjustment piston can be preloaded in one direction—preferably into the inactive position—and the pressure medium actuation direction counteracts the preload. A single-action configuration of the pressure medium cylinders can reduce the number of required feed lines, with a double-action configuration also generally being possible, however.

The latch operating actuators 19 are at least approximately spaced so far from the rotator axis of rotation 10 as the adjustment surface of the latch adjustment parts 14. The adjustment surface of the latch adjustment parts 14 can be formed by the aforesaid adjustment ring 16 whose diameter can substantially correspond to the diameter of the part circle on which the latch adjustment operating actuators 19 are arranged, cf. FIG. 5.

Whereas the adjustment ring 16 co-rotates with the coupling portion 6 in accordance with the rotation of the rotary rotator part 9, the latch operating actuators 19 are rotationally fixedly fastened or supported at the rotator attachment part 9 so that the adjustment ring 16 can rotate beneath the latch operating actuators 19. An actuation of the latch adjustment parts 14 in any desired rotational positions can nevertheless be achieved since the adjustment ring 16 forms an engagement surface for the latch adjustment actuators 19 independently of the rotational position.

The following quick hitch function can thus be achieved: Only the coupling portion 5 is moved into the coupling portion 6 at the tool side for the coupling, as a comparison of FIGS. 2-4 with FIG. 5 illustrates. On the inward movement, the latch elements 12 are automatically pressed radially inwardly in that they slide beyond the contour of the coupling part 6 at the tool side. If the two coupling portions 5 and 6 reach the position completely moved apart, the latch elements 12 can automatically move out into their latched position and can engage behind the coupling portion 6 at the tool side in order hereby to latch the two coupling portions 5 and 6 to one another.

If the two coupling portions 5 and 6 should be unlatched, the latch operating actuators 19 at the latch articulation part 8 not co-rotating are moved out or are moved toward the adjustment ring 16 of the latch adjustment parts 14, whereby the latch adjustment parts 14 at the coupling portion 6 are traveled. The slanted surfaces 18 of the latch adjustment parts 14 in this respect slide along the latch elements 12 and press them into their unlatching position so that the coupling portion 5 at the rotator side can be pulled upwardly out of the coupling portion 6 in the further process.

Numerous characteristics and advantages have been set forth in the foregoing description, together with details of structure and function. While the invention has been disclosed in several forms, it will be apparent to those skilled in the art that many modifications, additions, and deletions, especially in matters of shape, size, and arrangement of parts, can be made therein without departing from the spirit and scope of the invention and its equivalents as set forth in the following claims. Therefore, other modifications or embodiments as may be suggested by the teachings herein are particularly reserved as they fall within the breadth and scope of the claims here appended.

What is claimed is:

1. A quick hitch assembly for coupling and decoupling a tool at a rotator for rotating the tool, comprising:

a rotator comprising a stationary rotator attachment part that is attachable to a tool carrier and a rotary rotator part rotatable relative to the stationary rotator attachment part about an axis of rotation;

a quick hitch coupling comprising a male rotator coupling portion rigidly fastened to the rotary rotator part, and a female tool coupling portion fastenable to a tool;

wherein the rotator coupling portion and the tool coupling portion are configured to couple and uncouple by linear movement along a coupling axis in parallel with the axis of rotation;

at least one radially-outward biased latch element disposed on the rotator coupling portion and received within a latching contour in the tool coupling portion for latching the rotator coupling portion and the tool coupling portion;

a latch adjustment part movably disposed on the tool coupling portion;

wherein the latch adjustment part comprises an adjustment ring that extends in annular form about the axis of rotation in a plane perpendicular thereto and is supported on the tool coupling portion to be movable along an adjustment movement axis in parallel with the axis of rotation; and a latch operating actuator rigidly fastened to the stationary rotator attachment part for actuating the latch adjustment part for the unlatching and/or latching of the at least one latch element;

wherein the latch operating actuator comprises a plurality of hydraulic cylinders each with a piston therein, each piston movable along an axis parallel to the axis of rotation;

wherein the pistons of the hydraulic cylinders act upon the adjustment ring to move the adjustment ring in the axial direction parallel to the axis of rotation;

wherein the adjustment ring is rotatable about the axis of rotation relative to the pistons; and wherein the adjustment ring has a slanted surface that is arranged adjacent to the at least one latch element in a coupled position of the rotator coupling portion and the tool coupling portion and is configured to be brought into engagement with the at least one latch element by movement of the adjustment ring along its adjustment movement axis so that the slanted surface engaging obliquely to the adjustment movement axis slides along the at least one latch element and the adjustment movement of the adjustment ring is converted into a radially-inward latch movement of the at least one latch element to uncouple the rotator coupling portion from the latching in the tool coupling portion.

2. The quick hitch assembly of claim 1, wherein the at least one latch element is latchably and unlatchably supported transversely movable relative to the coupling axis.

3. The quick hitch assembly of claim 1, wherein the rotator coupling portion forms a stub-shaped coupling projection and the tool coupling portion forms a bowl-shaped coupling cut-out.

4. The quick hitch assembly of claim 3, wherein the bowl-shaped coupling cut-out has latching surfaces that are undercut with respect to the coupling axis and are configured to be engaged behind by the at least one latch element by a radial outward movement of the at least one latch element.

5. The quick hitch assembly of claim 1, wherein the at least one latch element comprises a plurality of latch elements, wherein the plurality of latch elements are arranged in a star shape and are each movably supported such that the plurality of latch elements can be latched and unlatched with a main movement component radial to the rotator axis of rotation.

6. The quick hitch assembly of claim 1, wherein the at least one latch element has a slanted surface set obliquely to the coupling axis and is supported such that, on the moving toward one another of the rotator coupling portion and the tool coupling portion along the coupling axis, the at least one latch element is automatically pressed back into an unlatching position and slides along a contour of the tool coupling portion to be latched until a latching contour of the tool coupling portion to be latched is reached and the at least one latch element is moved out into its latching position.

7. The quick hitch assembly of claim 1, wherein the at least one latch element is preloaded into its latching position by a preloading apparatus.

8. The quick hitch assembly of claim 7, wherein the preloading apparatus is a spring device.

9. The quick hitch assembly of claim 1, wherein the latch operating actuator is configured as single-action actuator, is preloaded into an inactive position by a preloading apparatus and can be acted on by a pressure fluid into its active position for actuating the adjustment ring.

10. The quick hitch assembly of claim 1, wherein the latch operating actuator is arranged at an outer peripheral side of the stationary rotator attachment part.

11. The quick hitch assembly of claim 1, wherein the latch operating actuator and an actuation surface of the adjustment ring for the latch operating actuator are arranged on reference circles that have the same radius about the rotator axis of rotation.

12. A machine assembly comprising:

the quick hitch assembly of claim 1.

13. The machine assembly of claim 12, wherein the quick hitch assembly forms a retrofittable assembly configured to be subsequently mounted at the rotator in one or both a rigid and releasable manner.

14. The machine assembly of claim 12, wherein the quick hitch assembly forms an integral component of the rotator.

15. The machine assembly of claim 12, wherein the rotator has a rotary drive for rotating the rotary rotator part with respect to the stationary rotator attachment part.

* * * * *